US005109766A

United States Patent [19]

Ontrop et al.

[11] Patent Number: 5,109,766

[45] Date of Patent: May 5, 1992

[54] ADJUSTABLE STROKE PUNCH PRESS

[75] Inventors: Patrick H. Ontrop; Robert L. Schockman, both of St. Henry; Frederick C. Bergman, Coldwater, all of Ohio

[73] Assignee: The Minster Machine Company, Minster, Ohio

[21] Appl. No.: 606,489

[22] Filed: Oct. 31, 1990

[51] Int. Cl.[5] ..... B30B 5/00; B30B 1/06

[52] U.S. Cl. ..... 100/257; 74/571 M; 83/530; 83/628; 100/282

[58] Field of Search ..... 100/257, 282, 291, 292; 74/595, 597, 603, 605, 571 M, 571 L; 72/446; 83/530, 628

[56] References Cited

U.S. PATENT DOCUMENTS

| | | | |
|---|---|---|---|
| 1,998,242 | 4/1935 | Klocke | 83/530 |
| 2,454,881 | 11/1948 | Michelman | 74/571 |
| 3,033,055 | 5/1962 | Hahnel | 72/446 |
| 3,765,266 | 10/1973 | Portmann | 74/571 |
| 4,156,387 | 5/1979 | Portmann | 100/257 |
| 4,160,409 | 7/1979 | Portmann | 100/257 |
| 4,216,681 | 8/1980 | Morisawa | 74/571 M |
| 4,354,411 | 10/1982 | Griese et al. . | |
| 4,748,883 | 6/1988 | Portmann | 83/530 |
| 4,785,732 | 11/1988 | Czapka et al. | 100/257 |
| 4,846,014 | 7/1989 | Shiga | 100/282 |
| 4,955,254 | 9/1990 | Kato | 100/257 |

FOREIGN PATENT DOCUMENTS

| | | | |
|---|---|---|---|
| 3345479 | 6/1985 | Fed. Rep. of Germany | 100/257 |
| 0092200 | 5/1984 | Japan | 100/257 |

*Primary Examiner*—Harvey C. Hornsby
*Assistant Examiner*—Randall E. Chin
*Attorney, Agent, or Firm*—Baker & Daniels

[57] ABSTRACT

The invention relates to an adjustable stroke punch press which has a crankshaft with an integral eccentric portion around which is disposed an eccentric sleeve, a connection arm, an L-shaped piston-like sleeve, a locking plate, and a clamping plate. During press operation, the eccentric sleeve is locked to the crankshaft through the locking plate and the clamping plate. Stroke length is adjusted by changing the eccentricity of the integral crankshaft eccentric portion relative to the eccentric sleeve. The eccentric sleeve is unlocked from the crankshaft and locked to the connection arm during stroke adjustment allowing the crankshaft to rotate relative thereto by utilizing the inching mode of the press.

14 Claims, 3 Drawing Sheets

ADJUSTABLE STROKE PUNCH PRESS

BACKGROUND OF THE INVENTION

The present invention relates to a punch press and more particularly to a variable stroke punch press in which the eccentricity of the drive, and therefore the length of the stroke, is adjusted by rotation of the crankshaft relative to the eccentric sleeve.

The stroke of a crankshaft, and therefore the displacement of the slide member, is defined as the distance the crankshaft moves between its top dead center and bottom dead center positions. This distance determines the maximum depth of drawing when the press is used to implement a drawing process, the maximum height available for a container edge turning process, and the maximum length of the article produced by an ironing or a backward extrusion process, for example.

The stroke length of the press is determined by the application, so a variety of applications require different stroke lengths. Many presses are designed having only one stroke length and are therefore not suited for different applications without substantially repositioning the tooling. In order to perform different applications utilizing only one press, it is known to provide a mechanism to change the stroke length by varying the eccentricity. As shown in U.S. Pat. No. 2,454,881 issued Nov. 30, 1948 to Michelman, a change in stroke length is accomplished by rotating the eccentric relative to the stopped crankshaft. The disadvantage is that the eccentric is buried within the crown of the press, surrounded by the housing and obscured by connection arms, hoses, belts, etc., whereby it is extremely difficult to reach and move the eccentric.

As shown in U.S. Pat. No. 4,785,732 issued Nov. 22, 1988, to Czapka et al., a change in stroke length is accomplished by fixing the eccentric with a bolt supported in the machine frame and rotating the crankshaft relative to the eccentric. Such mechanisms to fix the eccentric to the press frame are often complicated and unwieldy.

It is therefore desirable to provide a variable stroke punch press which overcomes the above disadvantages such that it would be simple to change the stroke length as well as easy to construct and maintain.

SUMMARY OF THE INVENTION

The present invention provides a punch press designed to satisfy the aforementioned needs by providing a variable stroke punch press in which the eccentric sleeve is fixed to the connection arm while the crankshaft is rotated, relative to the eccentric sleeve to change the effective eccentricity.

A simple connection arm locking mechanism is advantageous over the frame locking mechanism due to the overall design of press punches. With this design the stroke length of the press can be changed without the use of any external members connected to the press structure. In addition, the normal inching mode of the press is used to rotate the crankshaft relative to the fixed eccentric. Since the inching mode utilizes the same power to rotate the crankshaft during operation, no auxiliary mechanism or external forces are needed to change the eccentricity and therefore the stroke length, other than the normal press drive.

A press punch is provided with a variable stroke change mechanism which, during the stroke length change process, under hydraulic action, fixes the eccentric to the connection arm through a locking plate fastened to the eccentric while the crankshaft is rotated in the inching mode to the desired angle. Oil pressure in an oil cavity defined between a base plate and a piston-like sleeve radially mounted on the crankshaft, creates a horizontal force against the piston-like sleeve, and urges against the eccentric sleeve and locking plate to fix the eccentric to the crankshaft. When the pressure is relieved, the eccentric sleeve is unlocked from the crankshaft, allowing movement relative thereto.

In accordance with one form of the invention, the adjustable stroke press includes a rotatably supported crankshaft with an integral eccentric portion, an eccentric sleeve selectively rotatable relative to the eccentric portion but fixed relative to the crankshaft, a connection arm radially and rotatably disposed on the eccentric sleeve, and means for locking and unlocking the eccentric sleeve to and from the crankshaft and the connection arm.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENT

Figure 1:
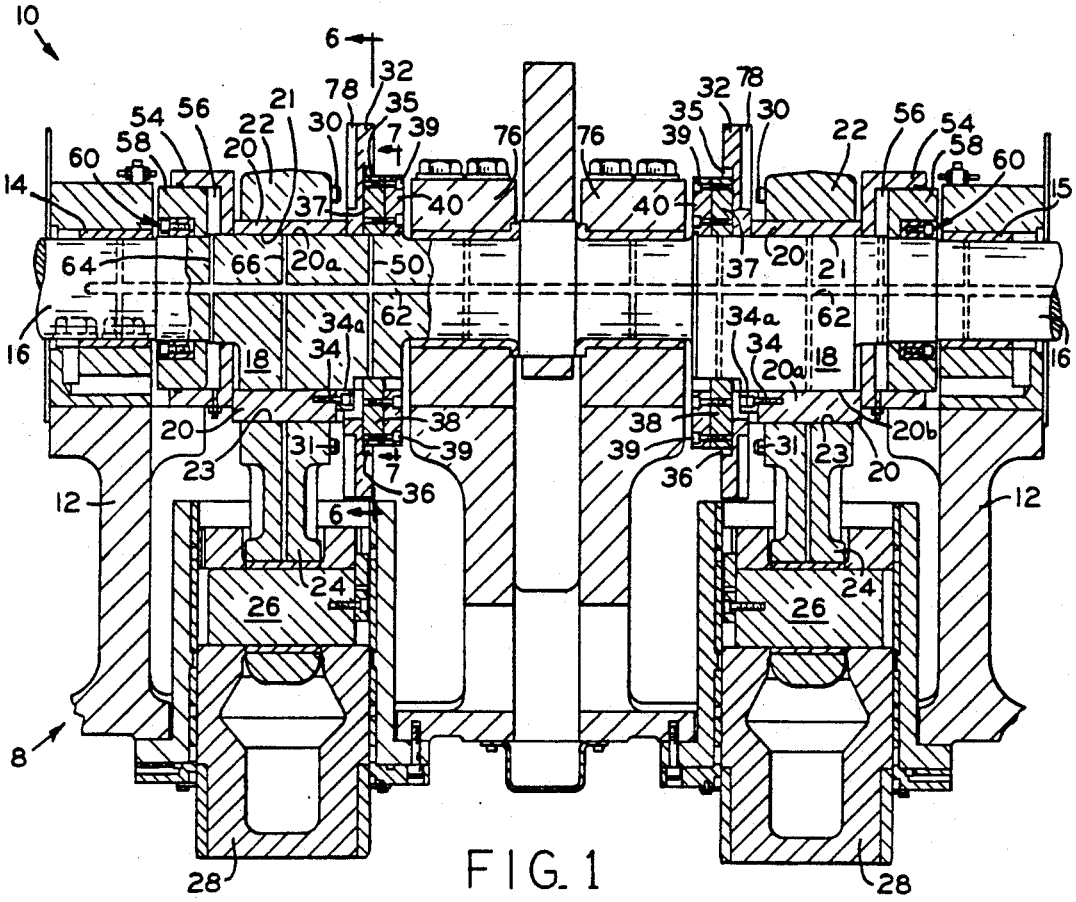
FIG. 1 is a front sectional view of the variable stroke punch press mechanism in the locked or operating mode.
Figure 2:
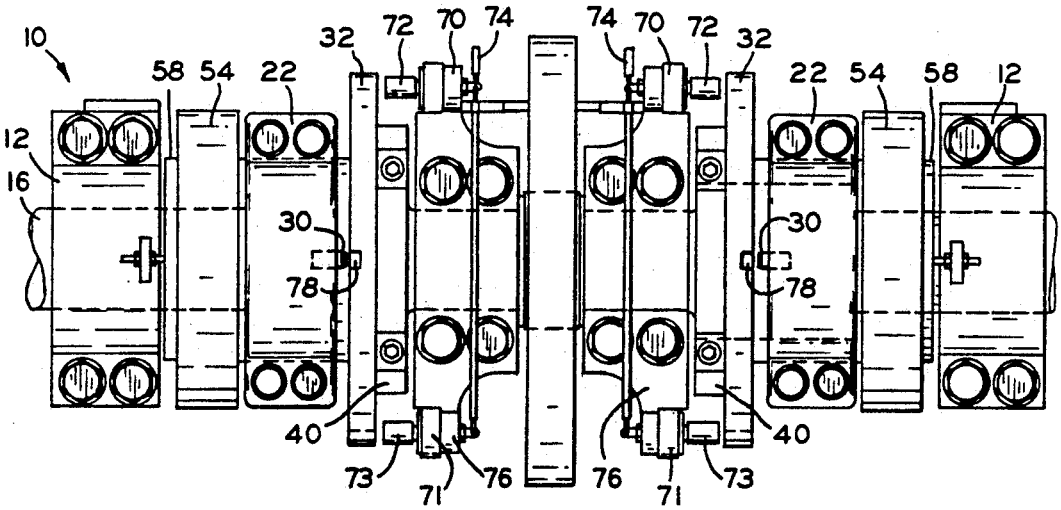
FIG. 2 is a plan view thereof.

Referring to FIGS. 1 and 2, there is shown the upper half of a punch press 8 and, more particularly, an embodiment of the variable stroke press mechanism 10. It is to be noted that the left and right halves of FIGS. 1 and 2 are mirror images of each other, therefore the same descriptions and reference numbers apply to both sides. Variable stroke press mechanism 10 includes a frame 12 having bushings 14 and 15 on either end rotatably supporting a crankshaft 16 having eccentric portions 18 thereon. Radially disposed on each eccentric portion 18 is an eccentric sleeve 20 which is limitedly moveable in the axial direction along crankshaft 16 and has an outer surface **20*a* that is eccentric to its inner surface 20*b*. Eccentric sleeve 20 has oil grooving (not shown) on its bore 21, and is preferably made of brass, although any suitable material may be utilized. Radially disposed on eccentric sleeve 20 is the bore 23 of a connection arm 22 which is fixedly connected through connection arm shank portion 24 and wrist pin 26 to connection slide 28. Protruding axially inward on connection arm 22 are locking pins 30 and 31**.

Figure 6:
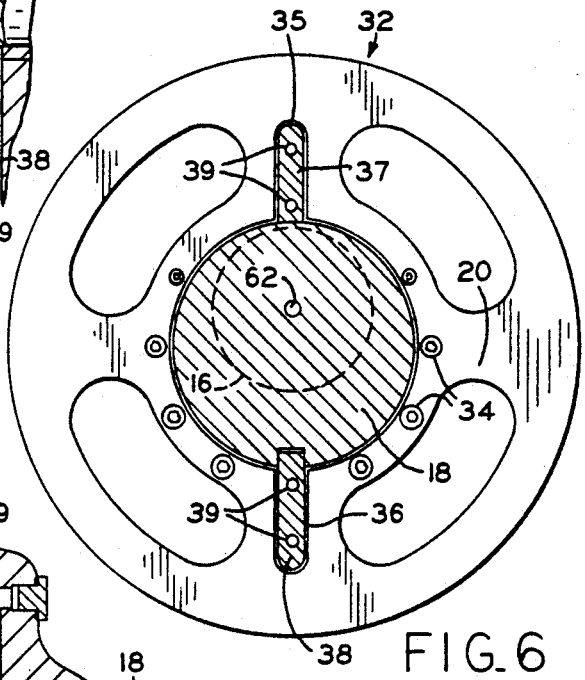
FIG. 6 is a sectional view of the locking plate taken along line 6—6 of FIG. 1.

Axially inward of eccentric sleeve 20 and radially disposed on crankshaft 16 is a locking plate 32 which is fixedly connected to eccentric sleeve 20 by screws 34 and key 34*a*. Other suitable methods of connecting the locking plate 32 to the eccentric sleeve 20 may be utilized as known in the art. Locking plate 32 is also axially moveable on crankshaft 16 since it is fixedly connected by screws 34 to eccentric sleeve 20. Thus, if either component moves, the other must move also. Referring to FIG. 6 there is shown locking plate 32 fixedly connected to eccentric sleeve 20 by an arcuate pattern of screws 34. Locking plate 32 has two elongated recesses 35 and 36 for receiving and engaging clamping plate keys 37 and 38 which are attached to clamping plate 40 by screws 39.

Figure 7:
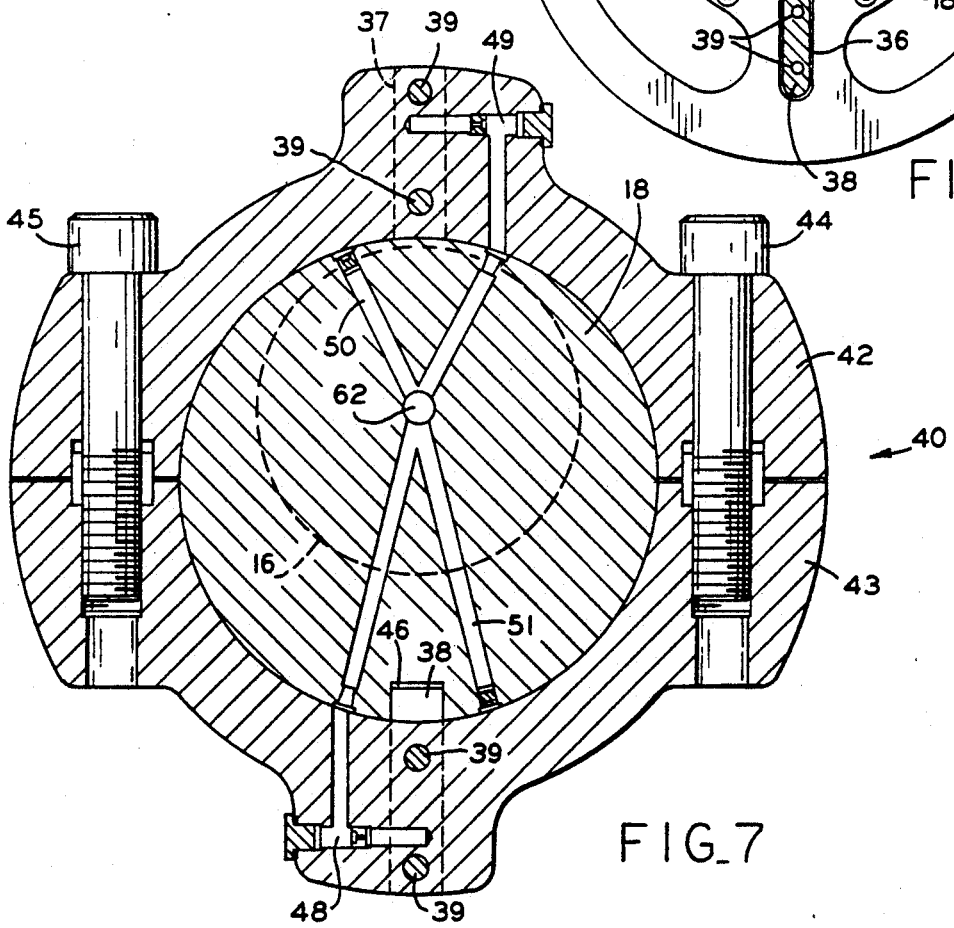
FIG. 7 is a sectional view of the clamping plate taken along line 7—7 of FIG. 1.

As shown in FIG. 7, clamping plate 40 is radially disposed and fixedly mounted on crankshaft 16 and is axially inward of locking plate 32 (FIG. 1). Referring to FIG. 7, clamping plate 40 is shown consisting of an upper half 42 and a lower half 43 fixedly joined by clamping plate bolts 44 and 45 which also help fix clamping plate 40 to crankshaft 16. Clamping plate 40 is also keyed to locking plate 32 by clamping plate keys 37 and 38 fixedly held to clamping plate 40 by screws 39. Key 38 extends into a recess 46 in crankshaft 16 for fixedly mounting clamping plate 40 thereto. Keys 37 and 38 are supplied with pressurized oil through clamping plate oil passages 48 and 49 (FIG. 7) by radial crankshaft oil passages 50 and 51 in communication with axial crankshaft oil passage 62. Fretting can occur between locking plate 32 and keys 37 and 38. By supplying oil to the clamping plate keys 37 and 38, a squeeze film of oil is developed which significantly reduces fretting.

Figure 5:
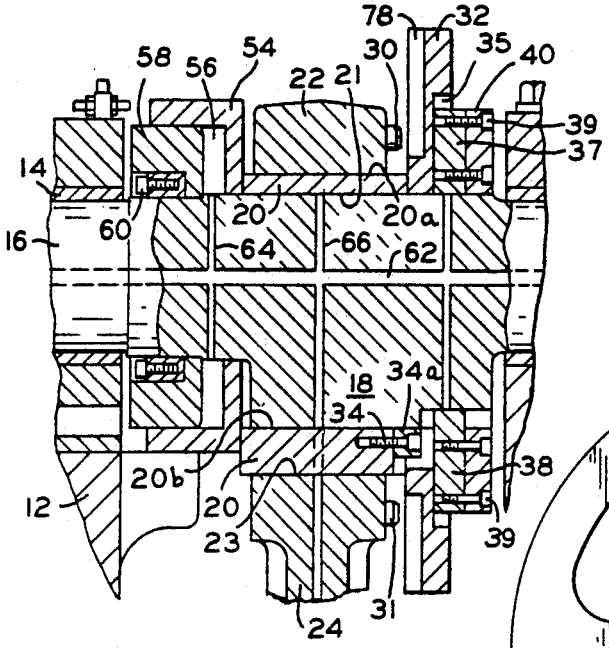
FIG. 5 is an enlarged, fragmentary front sectional view of the punch press variable stroke mechanism in the unlocked or operating mode with the crankshaft eccentric rotated 180° from its top dead center position.

Also radially disposed on crankshaft 16, axially outward of eccentric sleeve 20, is a piston-like sleeve 54 (FIG. 5) which axially moves on crankshaft 16 in response to the intake and discharge of pressurized oil in oil cavity 56 formed by and between sleeve 54 and a base plate 58 radially disposed on crankshaft 16 axially outward of sleeve 54. Base plate 58 is fixedly mounted on crankshaft 16 by wedge-type frictional locking device 60.

In order to supply pressurized oil to oil cavity 56, crankshaft 16 has an axial oil passage 62 communicating with a first radial oil passage 64. During normal press operation, oil cavity 56 is filled with pressurized oil which creates an axially inward force urging piston-like sleeve 54 against eccentric sleeve 20, thereby shifting eccentric sleeve 20 axially inward. Since eccentric sleeve 20 is fixedly connected to locking plate 32, locking plate 32 likewise moves axially inward to lockingly engage clamping plate 40 which is fixedly connected to crankshaft 16. The force present between these plates, not only prevents the locking plate 32 from disengaging with locking keys 37 and 38, it also creates sufficient frictional force between the plates to transmit the required press drive torque. If the press is overloaded and an excessive drive torque is required, the amount of torque which is in excess of that which can be transmitted via the frictional contact between locking plate 32 and clamping plate 40 will be conveyed through locking keys 37 and 38.

A second radial oil passage 66, communicating with axial oil passage 62, supplies pressurized oil to the grooves on the inner diameter of eccentric sleeve 20, forming a squeeze film condition between the eccentric sleeve 20 and the crankshaft 16.

Specifically referring to FIG. 2 showing a plan view of the variable stroke punching press mechanism 10, hydraulic cylinders 70 and 71 with pushers 72 and 73, are fixedly mounted radially outward on center bearing 76 which positions them axially inward of locking plate 32. They are supplied with hydraulic fluid via hydraulic line 74. The hydraulic cylinders and pushers are utilized to disengage locking plate 32 from clamping plate 40 during the stroke change process.

What will now be described is the process utilized to change the stroke length by changing the eccentricity of the punch press. Referring to FIGS. 1 and 2, the variable stroke punch press mechanism 10 is shown during operation. Oil cavity 56 is filled with pressurized oil supplied through first radial oil passage 64 communicating with axial oil passage 62. Since base plate 58 is fixedly mounted to crankshaft 16, the resulting axial force is transmitted to sleeve 54 which is displaced axially inward, thereby axially forcing locking plate 32 into engagement with clamping plate 40 fixedly mounted to crankshaft 16. Locking keys 37 and 38 engage locking plate recesses 35 and 36 stopping the axial movement and securely holding locking plate 32 and eccentric sleeve 20 in position. Pushers 72 and 73 are retracted and do not contact locking plate 32.

Figure 3:
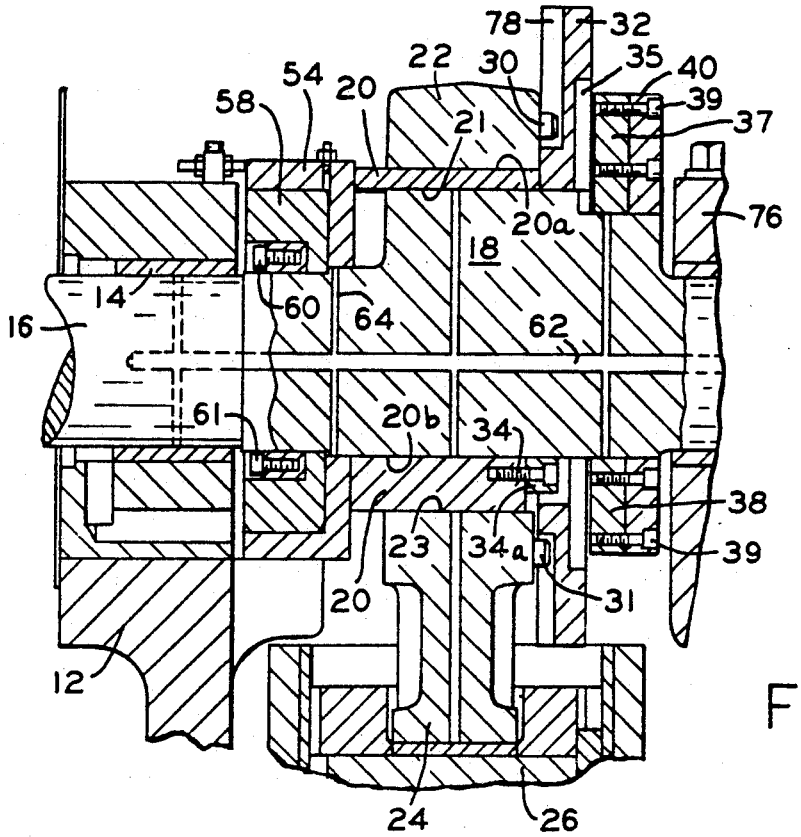
FIG. 3 is an enlarged, fragmentary front sectional view of the variable stroke punch press mechanism in the unlocked or disengaged mode with the crankshaft eccentric in its top dead center position.
Figure 4:
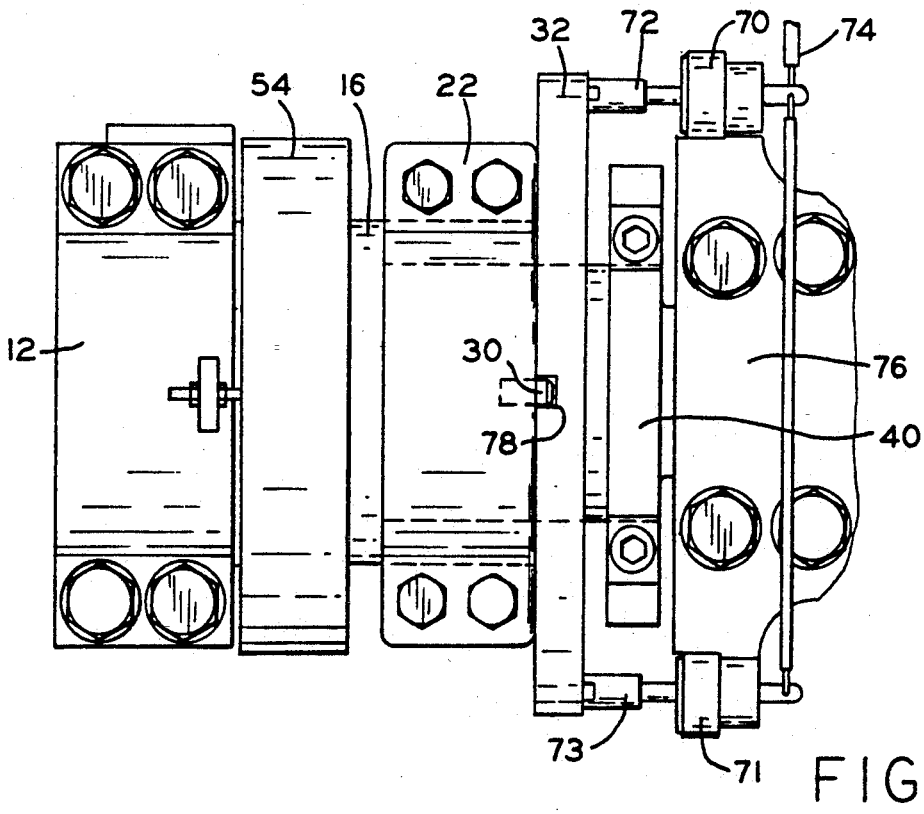
FIG. 4 is a fragmentary plan view thereof.

When the stroke length is to be changed, the pressurized oil is relieved, depleting the oil from oil cavity 56, thus eliminating the pressure between sleeve 54 and base plate 58. Referring to FIGS. 3 and 4, hydraulic cylinders 70 and 71 are energized through hydraulic line 74 which extend pushers 72 and 73 axially outward engaging locking plate 32. Pushers 72 and 73 axially move locking plate 32 so as to disengage with clamping plate 40 and locking keys 37 and 38, and engage with connection arm pins 30 and 31 which are received in connection arm pin recesses 78.

Since locking plate 32 is fixedly connected to eccentric sleeve 20, sleeve 20 also moves axially outward, consequently forcing piston-like sleeve 54 axially outward. At this point, the eccentric sleeve 20 and locking plate 32 are fixedly locked to the connection arm 22 by means of the connection arm pins 30 and 31 received in recesses 78.

Once this is accomplished, referring to FIG. 3, the crankshaft 16 is rotated through the desired angle while the eccentric sleeve 20 and locking plate 32 are held nonrotatable on connection arm 22. By rotating eccentric portion 18 of the crankshaft 16 relative to eccentric sleeve 20, the overall resultant eccentricity of the system is changed. Since the stroke length is dependent upon the additive relative eccentricities of eccentric sleeve 20 and crankshaft eccentric portion 18, by rotating the crankshaft eccentric portion 18 relative to the eccentric sleeve 20, the stroke length is changed. Once the eccentric sleeve 20 and locking plate 32 are fixed to the connection arm 22, the inching cycle of the press is utilized to slowly rotate the crankshaft 16 to the desired position by discrete steps.

After the crankshaft 16 rotation is complete, hydraulic cylinders 70 and 71 are deactivated, disengaging pushers 72 and 73 from locking plate 32. In order to relock the mechanism, pressurized oil is fed into axial oil passage 62 to oil cavity 56 via first radial oil passage 64. The fluid pressure in oil cavity 56 creates a horizontal force moving piston-like sleeve 54 axially inward, urging against eccentric sleeve 20 and locking plate 32.

Locking plate 32 thereby disengages from connection arm pins 30 and 31 to again engage and lock with clamping plate locking keys 37 and 38. The eccentric sleeve 20 and locking plate 32 are now locked onto crankshaft 16 and will rotate therewith.

When limited to two stroke lengths, such adjustment will not create any phase change, that is, the top of the stroke will occur when the crankshaft is at 0° for both the long and short stroke lengths.

Although the preferred embodiment comprises a sliding plate to lock and unlock the eccentric relative to the connection arm, other mechanisms are also possible.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An adjustable stroke press comprising:

a crankshaft rotatably supported on a frame, said crankshaft including an eccentric portion;

an eccentric sleeve radially disposed on said eccentric portion and rotatable relative to said eccentric portion during stroke length adjustment, said eccentric sleeve always fixed to said crankshaft during normal press operation;

a connection arm connected to a slide, said arm radially and rotatably disposed on said eccentric sleeve during normal press operation; and means for locking said eccentric sleeve to said crankshaft during normal press operation and for selectively unlocking said eccentric sleeve from said crankshaft and locking said sleeve to said connection arm during stroke length adjustment, whereby the stroke length can be changed by rotating said crankshaft relative to said eccentric sleeve, said eccentric sleeve capable of being locked to said crankshaft in a plurality of discrete different rotational positions relative to said crankshaft.

2. The press as recited in claim 1, wherein said means for locking said eccentric sleeve to said crankshaft includes:

a locking plate radially disposed on said crankshaft, said locking plate fixedly attached to said eccentric sleeve and moveable in an axial direction; and a clamping plate radially disposed and fixed on said crankshaft for engaging said locking plate.

3. The press as recited in claim 2, wherein said locking plate includes a recess therein, and said connection arm includes a connection pin selectively engageable in said recess.

4. The press as recited in claim 1, including means operatively connected to said eccentric sleeve for fixing said sleeve to said crankshaft, comprising:

a base plate fixedly mounted radially on said crankshaft, and a piston-like sleeve radially disposed on said crankshaft and axially moveable relative to said base plate, said piston-like sleeve defining an oil cavity with said base plate.

5. The press as recited in claim 4, wherein said crankshaft includes an oil passage for supplying pressurized oil to said oil cavity.

6. The press as recited in claim 1, wherein said eccentric sleeve is moveable in an axial direction.

7. The press as recited in claim 1, wherein said means for locking comprises a first locking element non-rotatably connected to said eccentric sleeve, said first locking element supported on said crankshaft and axially moveable thereon, said first locking element having one of a protrusion and recess aligned with the other of a protrusion and recess on said connection arm, said protrusion and recess being selectively engageable with each other to thereby positively lock said first locking element and said eccentric sleeve to said connection arm during stroke length adjustment.

8. The press as recited in claim 7, wherein said means for locking further includes a second locking element fixed to said crankshaft, said second locking element including one of a second protrusion and second recess aligned with the other of a second protrusion and second recess said second protrusion and second recess being selectively engageable with each other to lock said eccentric sleeve to said crankshaft when said first locking element is disengaged from said connection arm.

9. The press as recited in claim 7, wherein said means for locking includes hydraulic pusher means for urging said locking plate into engagement with said connection arm.

10. An adjustable stroke comprising:

a crankshaft rotatably supported on a frame, said crankshaft including an eccentric portion;

an eccentric sleeve radially disposed on said eccentric portion and selectively rotatable relative to said eccentric portion, said eccentric sleeve fixed to said crankshaft during normal press operation;

a connection arm connected to a slide, said arm radially and rotatably disposed on said eccentric sleeve; and means for locking said eccentric sleeve to said crankshaft during normal press operation and for selectively unlocking said eccentric sleeve from said crankshaft and locking said sleeve to said connection arm during stroke length adjustment, whereby the stroke length can be changed by rotating said crankshaft relative to said eccentric sleeve, said means for locking comprising a locking plate axially moveable on said crankshaft, first keying means on said connection arm and one side of said locking plate for selectively interlocking said plate and connection arm during stroke adjustment, and second keying means on said crankshaft and the other side of said plate for fixing said plate to said crankshaft during normal press operation, and means for delivering oil under pressure to said second keying means during normal press operation to develop an oil film between engaged surfaces of said second keying means, thereby reducing fretting therebetween.

11. The press as recited in claim 10, including clamp means for axially urging said second keying means into engagement.

12. The press as recited in claim 11, wherein said eccentric sleeve is axially moveable and said clamp means comprises a hydraulic cylinder engageable with said eccentric sleeve.

13. An adjustable stroke press comprising:

a crankshaft rotatably supported on a frame, said crankshaft including an eccentric portion, and an axial oil passage for supplying pressurized oil to a first radial oil passage;

a base plate fixedly mounted on the outer circumference of said crankshaft;

an eccentric sleeve radially disposed on the outer circumference of said eccentric portion, said eccentric sleeve moveable in an axial direction;

a connection arm radially disposed on said eccentric sleeve;

a locking element fixedly axially shiftable between a first position locked to the crankshaft and unlocked from the connection arm, and a second position locked to the connection arm and unlocked from the crankshaft;

a piston-like sleeve radially disposed on said crankshaft axially inward of said base plate, said piston-like sleeve axially moveable on said crankshaft; and an oil cavity formed between said base plate and said piston-like sleeve, said oil cavity communicating with said first radial oil passage;

said piston-like sleeve urging said eccentric into a locked position with said crankshaft when said oil cavity is pressurized.

14. An adjustable stroke press comprising:

a crankshaft rotatably supported on a frame, said crankshaft including an eccentric portion, and an axial oil passage for supplying pressurized oil to a first radial oil passage;

a base plate fixedly mounted on the outer circumference of said crankshaft;

an eccentric sleeve radially disposed on the outer circumference of said eccentric portion, said eccentric sleeve moveable in an axial direction;

a connection arm radially disposed on said eccentric sleeve;

a locking element axially shiftable between a first position locked to the crankshaft and unlocked from the connection arm, and a second position locked to the connection arm and unlocked from the crankshaft; said locking element comprising a locking plate radially disposed on said crankshaft on a side of said eccentric sleeve opposite said piston-like sleeve, said locking plate fixedly mounted to said eccentric sleeve and moveable in an axial direction, and a clamping plate radially disposed on said crankshaft axially on a side of said locking plate opposite said connection arm for engaging said locking plate during press operation;

a piston-like sleeve radially disposed on said crankshaft axially inward of said base plate, said piston-like sleeve axially moveable on said crankshaft;

an oil cavity formed between said base plate and said piston-like sleeve, said oil cavity communicating with said first radial oil passage;

said piston-like sleeve urging said eccentric into a locked position with said crankshaft when said oil cavity is pressurized.

* * * * *

UNITED STATES PATENT AND TRADEMARK OFFICE

CERTIFICATE OF CORRECTION

PATENT NO. : 5,109,766

DATED : May 5, 1992

INVENTOR(S) : Patrick H. Ontrop et al.

It is certified that error appears in the above-identified patent and that said Letters Patent is hereby corrected as shown below:

Claim 13, Column 7, Line 15, delete "fixedly".

Signed and Sealed this

Thirtieth Day of August, 1994

*Attest:*

*Attesting Officer*

BRUCE LEHMAN

*Commissioner of Patents and Trademarks*

US005109766A

REEXAMINATION CERTIFICATE (2250th)

United States Patent [19]

[11] B1 5,109,766

Ontrop et al.

[45] Certificate Issued Mar. 22, 1994

[54] ADJUSTABLE STROKE PUNCH PRESS

[75] Inventors: Patrick H. Ontrop; Robert L. Schockman, both of St. Henry; Frederick C. Bergman, Coldwater, all of Ohio

[73] Assignee: The Minster Machine Company, Minster, Ohio

Reexamination Request:
No. 90/003,036, Apr. 26, 1993

Reexamination Certificate for:

| | |
|---|---|
| Patent No.: | **5,109,766** |
| Issued: | **May 5, 1992** |
| Appl. No.: | **606,489** |
| Filed: | **Oct. 31, 1990** |

Certificate of Correction issued May 5, 1992.

[51] Int. Cl.[5] ..... B30B 5/00; B30B 1/06

[52] U.S. Cl. ..... 100/257; 74/571 M; 83/530; 83/628; 100/282

[58] Field of Search ..... 100/257, 282, 291, 292; 74/595, 597, 603, 605, 571 M, 571 L; 72/446; 83/530, 628

[56] References Cited

U.S. PATENT DOCUMENTS

| | | | |
|---|---|---|---|
| 2,348,958 | 5/1944 | Celio | 103/38 |
| 3,857,345 | 12/1974 | Higgins | 112/79 |
| 3,871,311 | 3/1975 | Ciecior | 112/200 |
| 4,031,778 | 6/1977 | Fazekas | 74/571 L |
| 4,044,630 | 8/1977 | Adams | 74/600 |
| 4,387,566 | 6/1983 | Berchowitz | 60/518 |
| 4,538,336 | 9/1985 | Oliver | 299/426.6 |
| 4,858,815 | 8/1989 | Roberts | 228/2 |
| 4,878,288 | 11/1989 | Messner | 29/568 |
| 5,105,684 | 4/1992 | Imanishi | 74/600 |

FOREIGN PATENT DOCUMENTS

| | | |
|---|---|---|
| 8127545 | 4/1983 | Fed. Rep. of Germany . |
| 2740382 | 1/1987 | Fed. Rep. of Germany . |
| 8407274 | 8/1990 | Fed. Rep. of Germany . |

*Primary Examiner*—Timothy F. Simone

[57] ABSTRACT

The invention relates to an adjustable stroke punch press which has a crankshaft with an integral eccentric portion around which is disposed an eccentric sleeve, a connection arm, an L-shaped piston-like sleeve, a locking plate, and a clamping plate. During press operation, the eccentric sleeve is locked to the crankshaft through the locking plate and the clamping plate. Stroke length is adjusted by changing the eccentricity of the integral crankshaft eccentric portion relative to the eccentric sleeve. The eccentric sleeve is unlocked from the crankshaft and locked to the connection arm during stroke adjustment allowing the crankshaft to rotate relative thereto by utilizing the inching mode of the press.

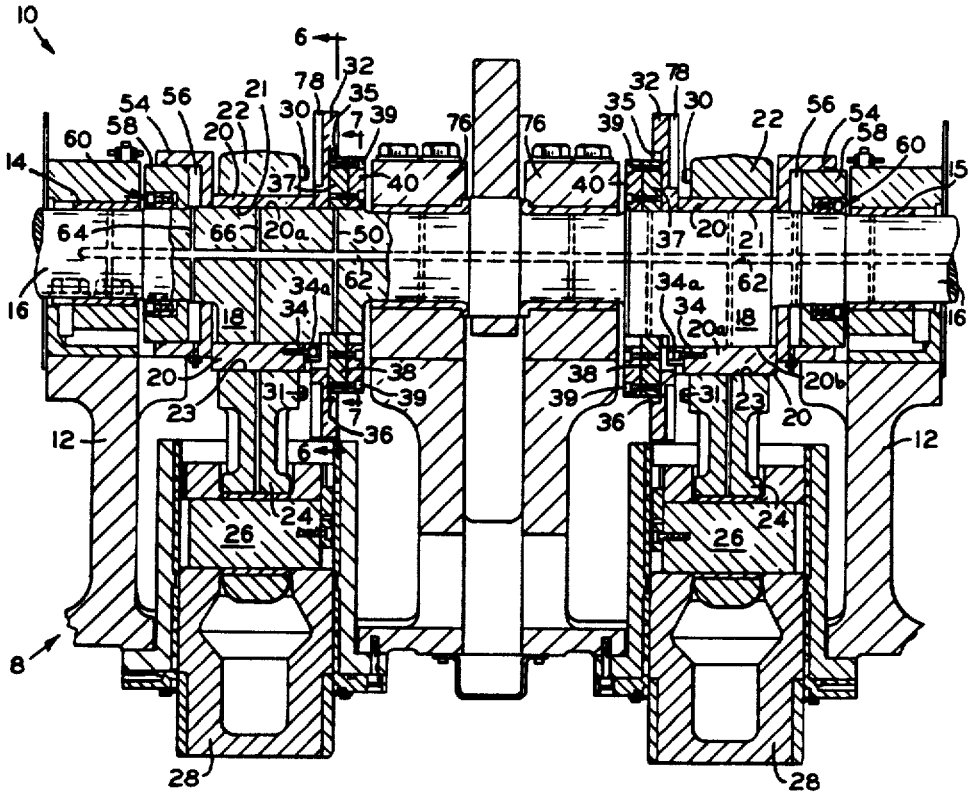

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 6 is cancelled.

Claims 1 and 8–14 are determined to be patentable as amended.

Claims 2–5 and 7, dependent on an amended claim, are determined to be patentable.

New claim 15 is added and determined to be patentable.

1. An adjustable stroke press comprising:

a crankshaft rotatably supported on a frame, said crankshaft including an eccentric portion;

an eccentric sleeve radially disposed on said eccentric portion and rotatable relative to said eccentric portion during stroke length adjustment, said eccentric sleeve always fixed to said crankshaft during normal press operation, *said eccentric sleeve being moveable in an axial direction;* a connection arm connected to a slide, said arm radially and rotatably disposed on said eccentric sleeve during normal press operation; and means for locking said eccentric sleeve to said crankshaft during normal press operation and for selectively unlocking said eccentric sleeve from said crankshaft and locking said sleeve to said connection arm during stroke length adjustment, whereby the stroke length can be changed by rotating said crankshaft relative to said eccentric sleeve, said eccentric sleeve capable of being locked to said crankshaft in a plurality of discrete different rotational positions relative to said crankshaft *to change said stroke length.*

8. The press as recited in claim 7, wherein said means for locking further includes a second locking element fixed to said crankshaft, said second locking element including one of a second protrusion and second recess aligned with the other of a second protrusion and second recess, said second protrusion and second recess being selectively engageable with [each] *the* other *of said second protrusion and second recess* to lock said eccentric sleeve to said crankshaft when said first locking element is disengaged from said connection arm.

9. The press as recited in claim 7, wherein said means for locking includes hydraulic pusher means for urging said *first* locking [plate] *element* into engagement with said connection arm.

10. An adjustable stroke *press* comprising:

a crankshaft rotatably supported on a frame, said crankshaft including an eccentric portion;

an eccentric sleeve radially disposed on said eccentric portion and selectively rotatable relative to said eccentric portion, said eccentric sleeve fixed to said crankshaft during normal press operation;

a connection arm connected to a slide, said arm radially and rotatably disposed on said eccentric sleeve; and means for locking said eccentric sleeve to said crankshaft during normal press operation and for selectively unlocking said eccentric sleeve from said crankshaft and locking said sleeve to said connection arm during stroke length adjustment, whereby the stroke length can be changed by rotating said crankshaft relative to said eccentric sleeve, said means for locking comprising a locking plate axially moveable on said crankshaft, first keying means on said connection arm and one side of said locking plate for selectively interlocking said plate and connection arm during stroke adjustment, and second keying means on said crankshaft and the other side of said plate for fixing said plate to said crankshaft during normal press operation, and means for delivering oil under pressure to said second keying means during normal press operation to develop an oil film between engaged surfaces of said second keying means, thereby reducing fretting therebetween.

11. The press as recited in claim 10, including [clamp] *piston* means for axially urging said second keying means into engagement.

12. The press as recited in claim 11, wherein said eccentric sleeve is axially moveable and said [clamp] *piston* means comprises a [hydraulic cylinder] *piston-like sleeve defining a hydraulic cavity, said piston-like sleeve* engageable with said eccentric sleeve.

13. An adjustable stroke press comprising:

a crankshaft rotatably supported on a frame, said crankshaft including an eccentric portion, and an axial oil passage for supplying pressurized oil to a first radial oil passage;

a base plate fixedly mounted on the outer circumference of said crankshaft;

an eccentric sleeve radially disposed on the outer circumference of said eccentric portion, said eccentric sleeve moveable in an axial direction;

a connection arm radially disposed on said eccentric sleeve;

a locking element fixedly axially shiftable between a first position locked to the crankshaft and unlocked from the connection arm, and a second position locked to the connection arm and unlocked from the crankshaft;

a piston-like sleeve radially disposed on said crankshaft axially inward of said base plate, said piston-like sleeve axially moveable on said crankshaft; and an oil cavity formed between said base plate and said piston-like sleeve, said oil cavity communicating with said first radial oil passage;

said piston-like sleeve urging said eccentric *sleeve* into a locked position with said crankshaft when said oil cavity is pressurized.

14. An adjustable stroke press comprising:

a crankshaft rotatably supported on a frame, said crankshaft including an eccentric portion, and an axial oil passage for supplying pressurized oil to a first radial oil passage;

a base plate fixedly mounted on the outer circumference of said crankshaft;

an eccentric sleeve radially disposed on the outer circumference of said eccentric portion, said eccentric sleeve moveable in an axial direction;

a connection arm radially disposed on said eccentric sleeve;

a locking element axially shiftable between a first position locked to the crankshaft and unlocked from the connection arm, and a second position locked to the connection arm and unlocked from the crankshaft; said locking element comprising a locking plate radially disposed on said crankshaft on a side of said eccentric sleeve [opposite said piston-like sleeve], said locking plate fixedly mounted to said eccentric sleeve and moveable in an axial direction, and a clamping plate radially disposed on said crankshaft axially on a side of said locking plate opposite said connection arm for engaging said locking plate during press operation;

a piston-like sleeve radially disposed on said crankshaft axially inward of said base plate, said piston-like sleeve *disposed opposite said locking plate and* axially moveable on said crankshaft;

an oil cavity formed between said base plate and said piston-like sleeve, said oil cavity communicating with said first radial oil passage;

said piston-like sleeve urging said eccentric *sleeve* into a locked position with said crankshaft when said oil cavity is pressurized.

*15. An adjustable stroke press comprising:*

*a crankshaft rotatably supported on a frame, said crankshaft including an eccentric portion;*

*an eccentric sleeve radially disposed on said eccentric portion and rotatable relative to said eccentric portion during stroke length adjustment, said eccentric sleeve always fixed to said crankshaft during normal press operation;*

*a connection arm connected to a slide, said arm radially and rotatably disposed on said eccentric sleeve during normal press operation; and*

*means for locking said eccentric sleeve to said crankshaft during normal press operation and for selectively rotatably unlocking said eccentric sleeve from said crankshaft and locking said sleeve to said connection arm during stroke length adjustment, said locking means including a clamping plate fixed on said crankshaft, said locking means including piston means disposed on said crankshaft for hydraulically pressing said eccentric sleeve into frictional engagement with said clamping plate during normal press operation, whereby the stroke length can be changed by rotating said crankshaft relative to said eccentric sleeve, said eccentric sleeve during stroke length adjustment capable of being rotated relative to said crankshaft in a plurality of discrete different rotational positions relative to said crankshaft to change said stroke length.*

* * * * *